US006241091B1

(12) United States Patent
Moore et al.

(10) Patent No.: US 6,241,091 B1
(45) Date of Patent: Jun. 5, 2001

(54) DECORATIVE CONTAINER FOR STORING PLUNGER

(75) Inventors: Gregory Moore, 6102 N. 8th St., Philadelphia, PA (US) 19120; Peter Bressler, Philadelphia, PA (US); Zoey Juhng, Philadelphia, PA (US); John Coleman, Philadelphia, PA (US)

(73) Assignee: Gregory Moore, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/286,717

(22) Filed: Apr. 6, 1999

Related U.S. Application Data

(63) Continuation-in-part of application No. 08/740,844, filed on Nov. 4, 1996, now Pat. No. 5,927,492.

(51) Int. Cl.[7] ..... A47B 81/02; A47K 17/00

(52) U.S. Cl. ..... 206/349; D6/524; 4/255.11; 220/367.1; 220/79

(58) Field of Search ..... D6/524, 551; 4/255.01, 4/255.11, 255.12, 255.05; 206/15.2, 226, 349, 361, 362.2; 220/4.21, 4.24, 601, 661, 796, 797, 801, 802, 367.1; 312/204, 206

(56) References Cited

U.S. PATENT DOCUMENTS

| | | | | |
|---|---|---|---|---|
| D. 292,631 | | 11/1987 | Tash . | |
| D. 334,681 | | 4/1993 | Callicut . | |
| D. 383,935 | | 9/1997 | Zawalsky . | |
| D. 413,470 | * | 9/1999 | Burton | D6/551 |
| 2,212,230 | | 8/1940 | Davis . | |
| 2,606,708 | | 8/1952 | Irvan . | |
| 2,757,787 | * | 8/1956 | Sergent | 312/206 |
| 3,426,935 | * | 2/1969 | Swett | 220/796 |
| 3,709,397 | * | 1/1973 | Daenen | 220/796 |
| 4,192,561 | | 3/1980 | Gunn . | |
| 4,211,750 | * | 7/1980 | Gillespie | 312/206 |
| 4,432,451 | | 2/1984 | Hooser . | |
| 4,458,368 | | 7/1984 | Webb . | |
| 5,040,679 | | 8/1991 | Rehmann . | |
| 5,335,374 | | 8/1994 | Wilk et al. . | |
| 5,339,974 | * | 8/1994 | Raghunathan | 220/661 |
| 5,353,442 | | 10/1994 | Rotter . | |
| 5,456,356 | | 10/1995 | Kurzawa . | |
| 5,482,989 | * | 1/1996 | Koskiniemi | 524/404 |
| 5,927,492 | * | 7/1999 | Moore | 206/349 |

* cited by examiner

*Primary Examiner*—Jim Foster
(74) *Attorney, Agent, or Firm*—Akin, Gump, Strauss, Hauer & Feld, L.L.P.

(57) ABSTRACT

A decorative container is adapted for receiving and storing a plumbing plunger in a generally upright position. The decorative container includes a base which has a bottom wall and a sidewall. The sidewall extends upwardly from the bottom wall by a predetermined distance and extends around a perimeter of the bottom wall. The sidewall has a supporting lip which extends around a perimeter of the sidewall. A first part of the sidewall of the base proximate to the supporting lip has a first slot extending through the sidewall. The supporting lip extends over the first slot and at least partially conceals the first slot from being externally viewed. The container also includes a cover which has a lower end and a sidewall and which is releasably positioned on the supporting lip. The lower end of the cover member surrounds the sidewall of the base. A plumbing plunger is removably stored within the decorative container.

38 Claims, 7 Drawing Sheets

DECORATIVE CONTAINER FOR STORING PLUNGER

CROSS-REFERENCE TO RELATED APPLICATIONS

This application is a Continuation-in Part of U.S. application Ser. No. 08/740,844, filed Nov. 4, 1996, U.S. Pat. No. 5,927,492.

BACKGROUND OF THE INVENTION

The present invention relates generally to a container for storing elongated objects and, more particularly, to a decorative container for storing any one of a number of different sized and shaped plumbing plungers.

The use of plumbing plungers for taking care of clogs in the bathroom, kitchen and other locations throughout the home as well as within commercial and industrial settings is well known. In many households, business and industrial settings, such plumbing plungers are typically maintained in the bathroom, generally beside or behind a bathroom fixture, such as the toilet or sink. Storing a plumbing plunger in this manner is not only unsightly but is also unsanitary. In addition, such plumbing plungers become an attraction to children or pets who may be subjected to contact with infectious bacteria which may remain on a portion of the plunger after use.

The present invention overcomes many of the problems associated with the storage of a plumbing plunger by providing a convenient closable decorative container. The container in accordance with the present invention is adapted for the storage in an upright position of virtually any type or size of plumbing plunger in general use in virtually any location. The container in accordance with the present invention is neat, attractive and maintains a plumbing plunger safely out of the sight and reach of children and pets and yet is easily accessible when needed. The container in accordance with the present invention maintains a plunger stored therein in a sanitary condition, while providing a neat and pleasant outward appearance.

SUMMARY OF THE INVENTION

Briefly stated, the present invention comprises a decorative container for receiving and storing a plumbing plunger in a generally upright position. The container includes a base which has a bottom wall and a sidewall. The sidewall extends upwardly from the bottom wall by a predetermined distance and extends around a perimeter of the bottom wall. The sidewall has a supporting lip which extends around a perimeter of the sidewall. A first part of the sidewall of the base proximate to the supporting lip has a first slot which extends through the sidewall. The supporting lip extends over the first slot and at least partially conceals the first slot from being externally viewed. The container further includes a cover which has a lower end and a sidewall and which is releasably positioned on the supporting lip. The lower end of the cover member surrounds the sidewall of the base.

In another embodiment, the present invention comprises a decorative container for receiving and storing a plumbing plunger in a generally upright position. The container includes a base which has a bottom wall and a sidewall which extends upwardly from the bottom wall by a predetermined distance and which extends around a perimeter of the bottom wall. The sidewall has a supporting lip which extends around a perimeter of the sidewall. The sidewall tapers inwardly above the supporting lip. The container further includes a cover which has a lower end and a sidewall and which is releasably positioned on the supporting lip. The lower end of the cover member surrounds and snugly engages the sidewall of the base above the supporting lip. The sidewall of the cover tapers generally inwardly from the lower end to an upper portion.

In another embodiment, the present invention comprises a decorative container for receiving and storing a plumbing plunger in a generally upright position. The container comprises a base which has a bottom wall having a plurality of holes extending therethrough and a sidewall extending upwardly from the bottom wall by a predetermined distance. The sidewall further extends around a perimeter of the bottom wall and has a supporting lip which extends around a perimeter of the sidewall. A first part of the sidewall of the base proximate to the supporting lip has a first slot extending therethrough. The supporting lip extends over the first slot and at least partially conceals the first slot from being externally viewed. The combination further includes a cover which is releasably positioned on the supporting lip and has a lower end and a sidewall. The lower end of the cover member surrounds the sidewall of the base.

In yet another embodiment, the present invention comprises a decorative container for receiving and storing a plumbing plunger in a generally upright position. The container comprises a base which has a bottom wall. The bottom wall has at least one hole extending therethrough and a raised perimeter extending upwardly therefrom surrounding each of the at least one hole. The container further comprises a cover which is releasably positioned on the base.

In yet another embodiment, the invention includes a combination plumbing plunger and decorative container therefor. The combination comprises a decorative container which includes a base which has a bottom wall and a sidewall. The sidewall extends upwardly from the bottom wall by a predetermined distance and which extends around a perimeter of the bottom wall. The sidewall has a supporting lip which extends around a perimeter of the sidewall. A first part of the sidewall of the base proximate to the supporting lip has a first slot which extends through the sidewall. The supporting lip extends over the first slot and at least partially conceals the first slot from being externally viewed. The container also includes a cover which has a lower end and a sidewall and which is releasably positioned on the supporting lip. The lower end of the cover member surrounds the sidewall of the base. The combination further includes a plumbing plunger which is removably stored within the decorative container.

In another embodiment, the present invention is a combination plumbing plunger and decorative container therefor. The combination comprises a decorative container which includes a base having a bottom wall. The bottom wall has a plurality of holes extending therethrough and a sidewall extending upwardly from the bottom wall by a predetermined distance. The sidewall further extends around a perimeter of the bottom wall. The sidewall has a supporting lip which extends around a perimeter of the sidewall. A first part of the sidewall of the base proximate to the supporting lip has a first slot which extends therethrough. The supporting lip extends over the first slot and at least partially concealing the first slot from being externally viewed. The container further includes a cover which is releasably positioned on the supporting lip and has a lower end and a sidewall. The lower end of the cover member surrounds the sidewall of the base. The combination further includes a plumbing plunger which is removably stored within the decorative container.

In still another embodiment, the present invention is a combination plumbing plunger and decorative container therefor. The combination comprises a decorative container which includes a base which has a bottom wall. The bottom wall has at least one hole extending therethrough and a raised perimeter extending upwardly therefrom surrounding each of the at least one hole. The container further includes a cover which is releasably positioned on the base. The combination further includes a plumbing plunger which is removably stored within the decorative container.

BRIEF DESCRIPTION OF THE SEVERAL VIEWS OF THE DRAWINGS

The foregoing summary, as well as the following detailed description of the preferred embodiments of the present invention, will be better understood when read in conjunction with the appended drawings. Although, in the drawings, preferred embodiments are shown, it will be appreciated by those of ordinary skill in the art that the present invention is not limited to the arrangements and instrumentalities shown. In the drawings.

DETAILED DESCRIPTION OF THE INVENTION

Figure 1:
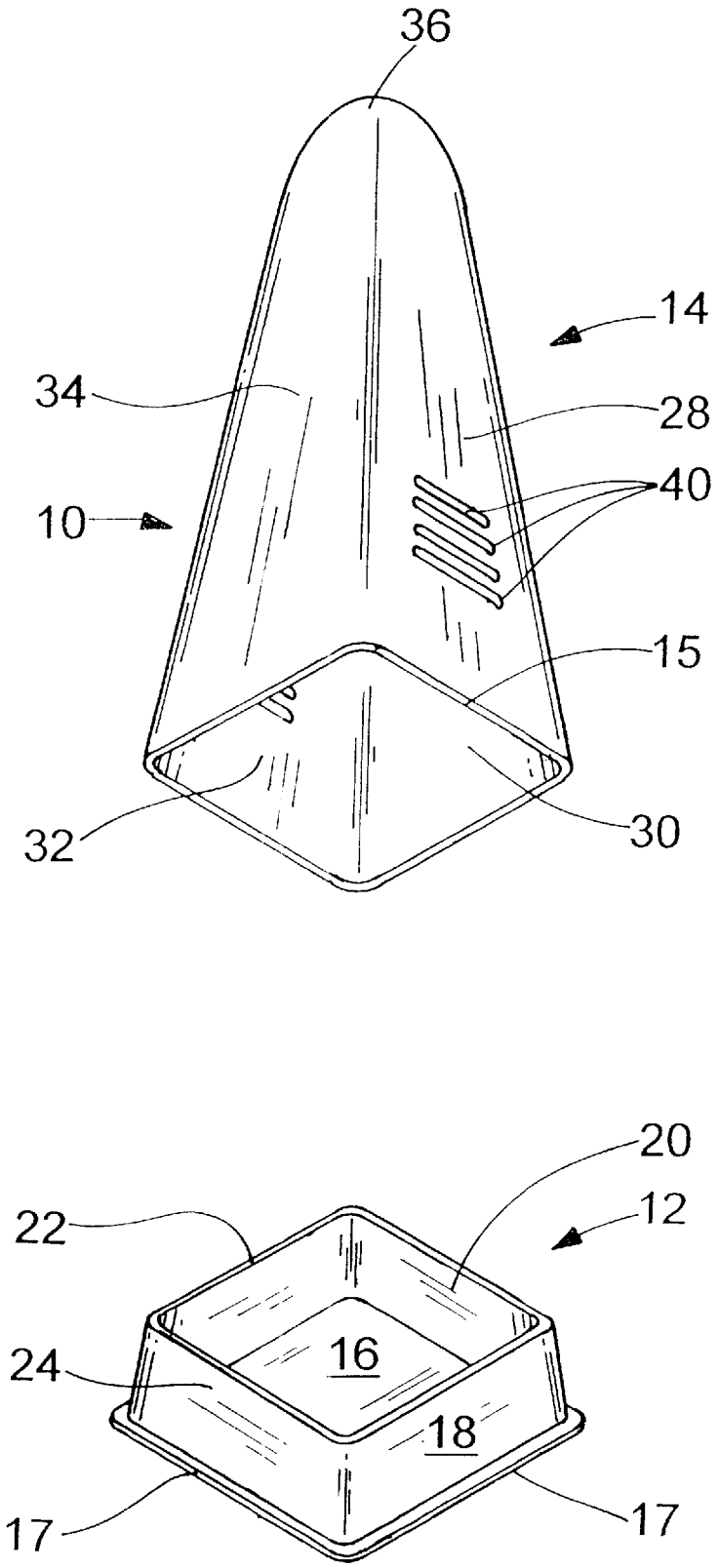
FIG. 1 is an exploded perspective view of a container for storing a plumbing plunger in accordance with a first preferred embodiment of the present invention.

Referring to the drawings, wherein the same reference numerals are used to indicate like components throughout the several figures, there is shown in FIG. 1 an exploded perspective view of a decorative container 10 for storing a plumbing plunger in accordance with a first preferred embodiment of the present invention. The container 10 is comprised of a base member 12 and a cover member 14. In the present embodiment, both the base member 12 and the cover member 14 are molded of a plastic material which is preferably of a type well known to those of ordinary skill in the art. Preferably, both the base member 12 and the cover member 14 are made of the same plastic material.

Figure 3:
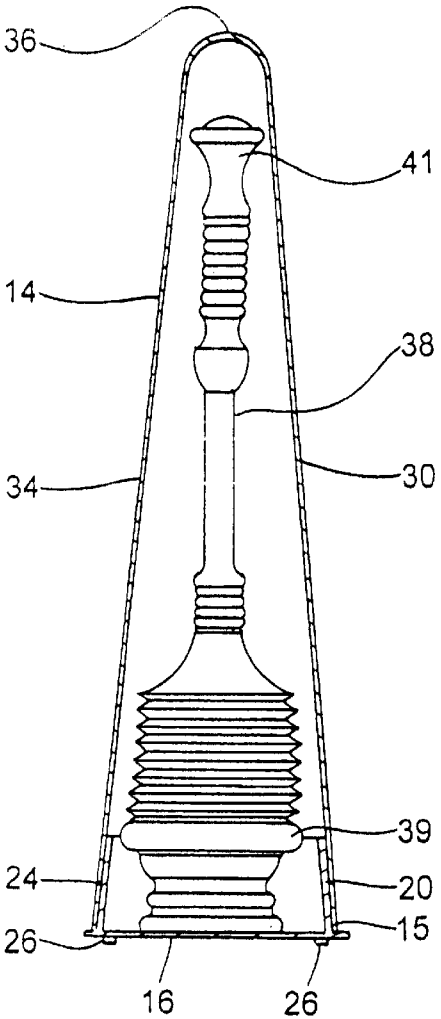
FIG. 3 is a cross-sectional view of the container shown in FIG. 2 taken along line 3–3 of FIG. 2.
Figure 2:
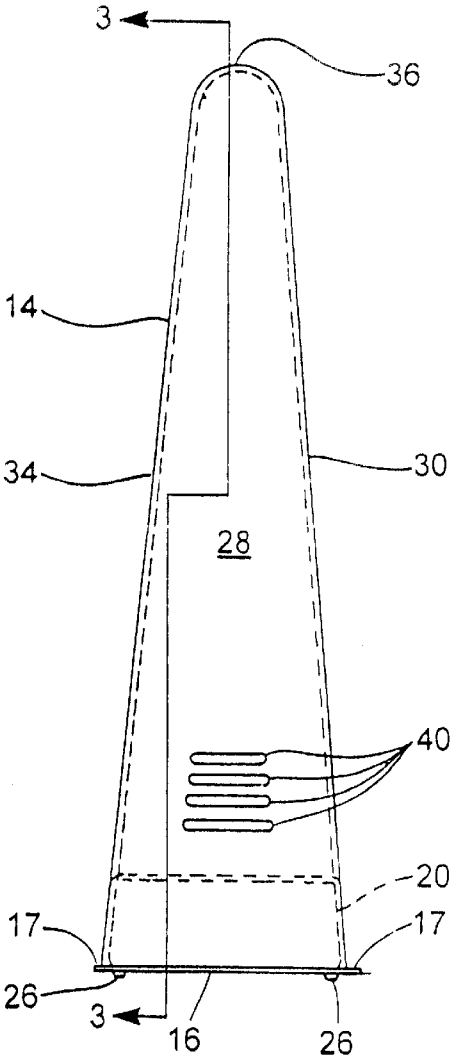
FIG. 2 is a right side elevational view of the container shown in FIG. 1.
Figure 4:
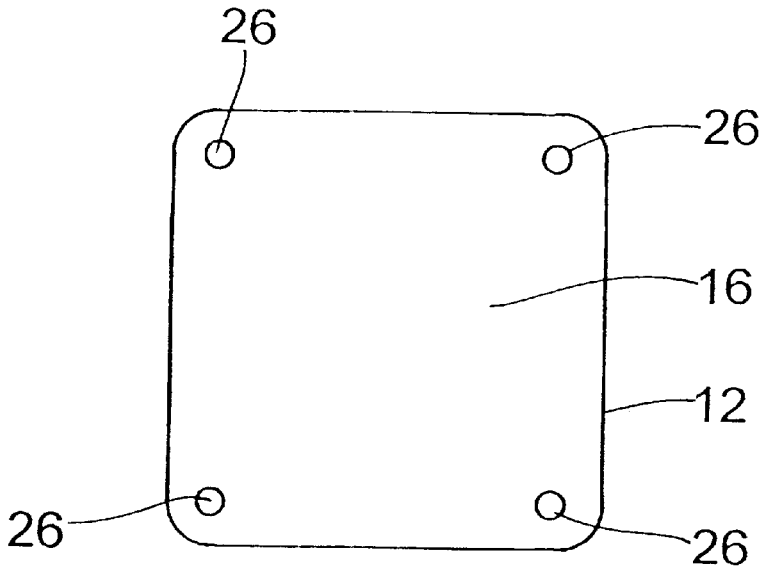
FIG. 4 is a bottom plan view of the container shown in FIG. 1.
Figure 7:
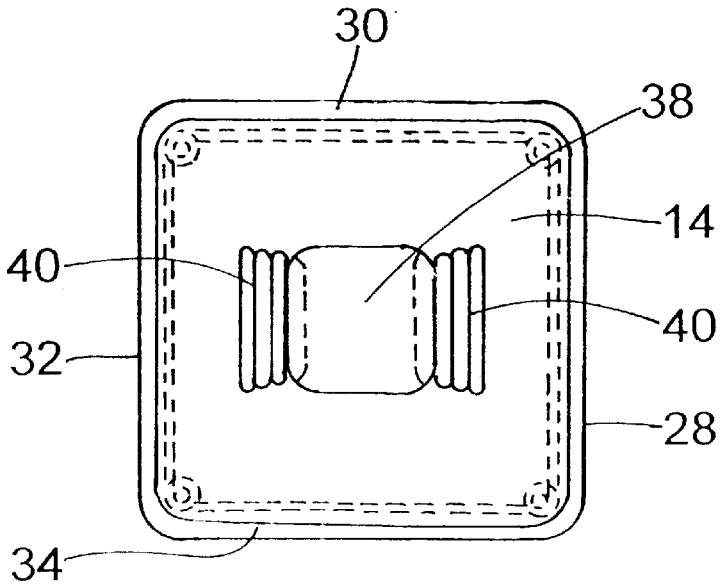
FIG. 7 is a view similar to FIG. 5 showing additional details of the container in phantom.
Figure 6:
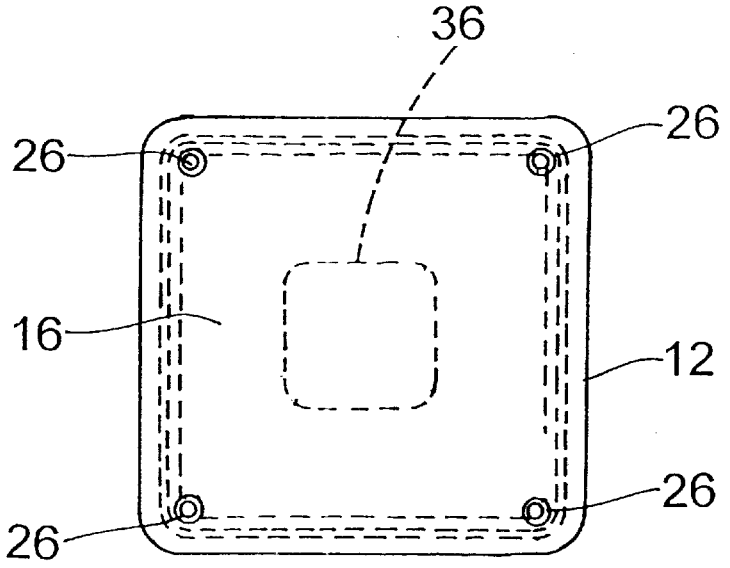
FIG. 6 is a view similar to FIG. 4 showing details of the container in phantom.

Referring to FIGS. 1, 2 and 4, the base member 12 is generally square in plan view with smoothly rounded comers and is comprised of a generally flat bottom wall 16 and four intersecting or adjoining sidewalls 18, 20, 22 and 24. As best shown in FIGS. 1 and 2, the sidewalls 18, 20, 22, 24 extend generally upwardly from the upper side of the bottom wall 16 by a predetermined distance with a slight inward taper. In addition, the comers at which the sidewalls 18, 20, 22, 24 intersect each other are generally smoothly rounded as best shown in FIG. 1 to provide a pleasing appearance. A portion of the bottom wall 16 extends outwardly beyond each of the sidewalls 18, 20, 22, 24 to establish a generally continuous supporting lip 17 which extends all of the way around the base member 12 for purposes which will hereinafter become apparent. In this manner, the base member 12 is generally tray-like in configuration. Preferably, the base member 12 is sized so that it can conveniently receive and retain within the area defined by the sidewalls 18, 20, 22, 24 virtually any standard size plunger 38 (see FIG. 3) such that at least a substantial portion of the functioning portion 39 of the plunger 38 is contained within the sidewalls 18, 20, 22, 24 which serve as retainer walls. In this manner, any excess liquid, solid or other material which may remain on the plunger 38 is captured and maintained within the base member 12 once the plunger 38 is installed therein, as shown in FIG. 3.

As best shown in FIGS. 2 and 4, the underside of the bottom wall 16 of the base member 12 includes four spaced apart feet 26. The feet 26 function to raise the base member 12 a predetermined distance above the surface of the floor or other supporting surface. Preferably, the feet 26 are in the form of suction cups so that once the base member 12 is positioned on a floor or other supporting surface, the feet 26 also function to secure or hold the base member 12 in place. Preferably, the suction cups are made of a rubber material and are positioned on the bottom wall 16 to be generally aligned with the four comers established by the intersection of the four sidewalls 18, 20,22,24.

The cover member 14 is generally in the shape of a four-sided pyramid and includes four intersecting sidewalls 28, 30, 32 and 34 which taper inwardly to a generally smoothly curved upper portion 36. As with the base member 12, the comers where the sidewalls 28, 30, 32, 34 intersect or adjoin with each other, are generally smoothly curved as best shown in FIG. 1. The lower end 15 of the cover member 14 is generally square in cross section and is sized to have an inside dimension which is slightly greater than the outside dimension of the sidewalls 18, 20, 22, 24 of the base member 12 at their junction with the bottom wall 16. Preferably, the sidewalls 28, 30, 32 and 34 of the cover member 14 taper inwardly in substantially the same manner and extent as the inward taper of the sidewalls 18, 20, 22, 24 of the base member 12 so that when the cover member 14 is installed on the base member 12 as shown in FIG. 2, the sidewalls 18, 20, 22, 24 of the base member 12 are surrounded by and engage the corresponding lower portion of the sidewalls 28, 30, 32, 34 of the cover member 14 with a snug overlapping fit. As best shown in FIGS. 2 and 3, the distal ends of the sidewalls 28, 30, 32, 34 which form the lower end 15 of the cover member 14 engage and are supported by the supporting lip 17 of the bottom wall 16 of the base member 12 which extends slightly beyond the sidewalls 18, 20, 22, 24 as hereinbefore described.

Preferably, the length or height of the cover member 14 is at least slightly greater than the overall length of a standard plumbing plunger 38 and more preferably is at least slightly greater than the overall length of the longest standard plumbing plunger. Preferably, the taper of the sidewalls 28, 30, 32, 34 of the cover member 14 is such that the interior dimension proximate the upper portion 36 of the cover member 14 is large enough to receive the distal end of the handle 41 of any standard plumbing plunger 38 when held in an upright position as shown in FIG. 3.

Figure 5:
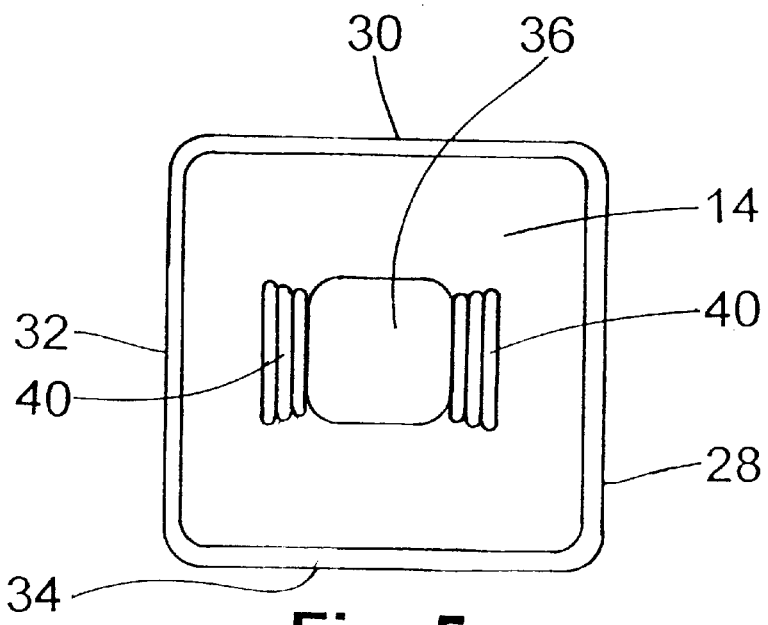
FIG. 5 is a top plan view of the container shown in FIG. 1.

As best shown in FIGS. 1, 2 and 5, a plurality of elongated openings or slots 40 extend through two of the sidewalls 28, 32 of the cover member 14. Preferably, the slots 40 are generally laterally centered within the sidewalls 20, 32 and are located slightly above the upper edge of the sidewalls 18, 20, 22, 24 of the base member 12. Preferably, there are four slots 40 of varying lateral length with the lowermost slot having the longest lateral length and the uppermost slot having the shortest lateral length to be consistent with the smoothly tapered appearance of the cover member 14. The slots 40 serve to provide ventilation to the interior of the container 10 to facilitate the removal of odor, to permit the escape of any moisture held within the base member 12 and to otherwise maintain a plumbing plunger 38 contained within the container 10 in a serviceable condition.

In using the container 10, the base member 12 is preferably placed at a desired location on a floor or other supporting surface for storing a plumbing plunger 38. The base member 12 is then pushed downwardly toward the floor or other supporting surface so that the suction cup feet 26 are actuated to engage and hold the base member 12 at the desired position on the floor or other supporting surface. It may be desirable to place a small amount of water on the undersurface of each of the suction cup feet 26 to improve gripping force. A plumbing plunger 38 may then be placed on the base member 12 in the area between the sidewalls 18, 20, 22, 24 in an upright position with the handle 41 of the plumbing plunger 38 extending upwardly as shown in FIG. 3. As previously noted, any liquid or solid materials left on the operating portion 39 of the plumbing plunger 38 are captured and retained within the base member 12. In this manner, the floor or other supporting surface is kept clean and sanitary.

Once the plumbing plunger 38 is installed within the base member 12 in an upright position as shown in FIG. 3, the cover member 14 is installed over the base member 12 as shown in FIGS. 2 and 3. Since the interior dimension of the cover member 14 is at least slightly greater than the dimensions of the plumbing plunger 38, the installation of the cover member 14 does not effect the upright position of the plumbing plunger 38. The lower end 15 of the cover member 14 engages and is supported by the base member lip 17. As previously noted, the sidewalls 28, 30, 32, 34 of the cover member 14 tightly engage the corresponding sidewalls 18, 20, 22, 24 of the base member 12 with a snug fit to thereby effectively secure the cover member 14 to the base member 12. In this manner, it is difficult for small children or pets to remove the cover member 14 from the base member 12 and thereby obtain access to the plumbing plunger 38. As previously stated, the slots 40 extending through the cover member 14 on opposite sidewalls 28, 32 provide cross ventilation to facilitate the removal of any moisture, odors or the like from the interior of the container 10 while the plumbing plunger 38 is being stored.

When it becomes necessary to use the plumbing plunger 38, the cover member 14 is removed by pulling the cover member 14 straight upwardly. Because of the suction cup feet 26, the base member 12 remains secured to the floor or other supporting surface. By pulling the cover member 14 straight upwardly with respect to the base member 12, the plumbing plunger 38 remains in its upright position as shown in FIG. 3 and is exposed and ready for use. The plumbing plunger 38 may then be removed from the base member 12 for use in breaking up a clog or the like. Thereafter, the plumbing plunger 38 may be returned to the base member 12 and the cover member 14 may be reinstalled on the base member 12 as described above.

Figure 8:
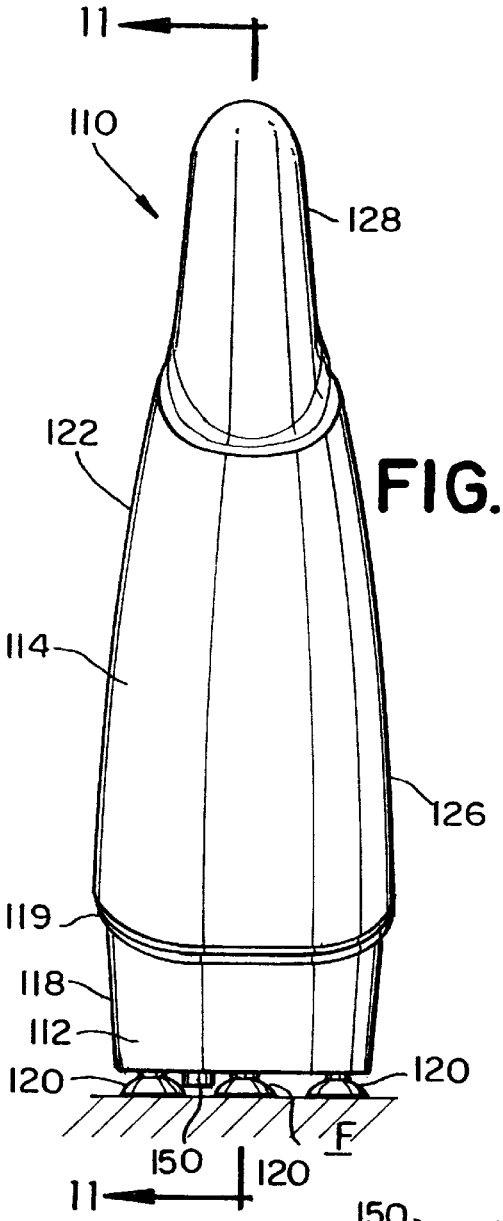
FIG. 8 is a front elevational view of a container for storing a plumbing plunger in accordance with a second preferred embodiment of the present invention.
Figure 9:
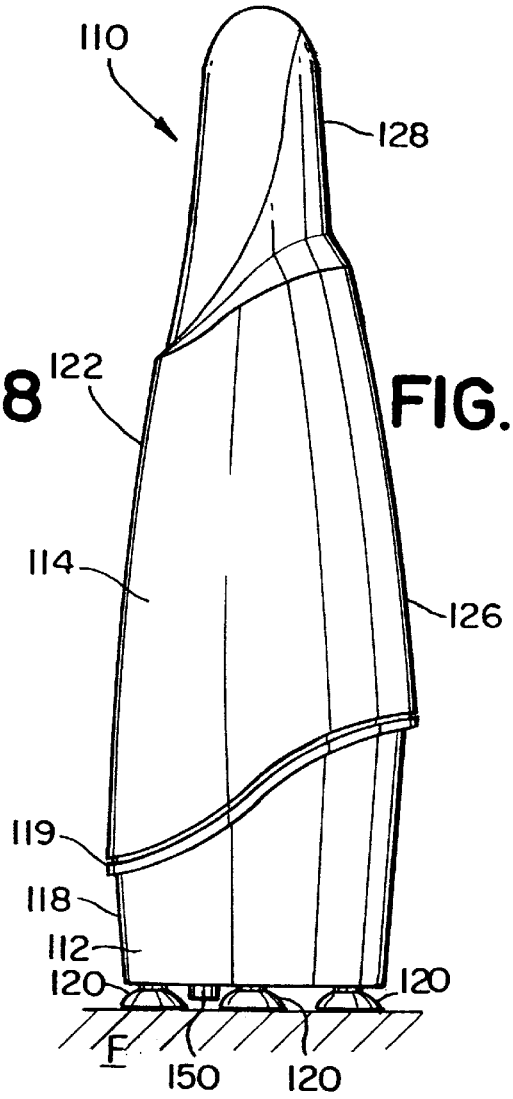
FIG. 9 is a right side elevational view of the container shown in FIG. 8.

A second preferred embodiment of the present invention is shown in FIGS. 8–13. There are shown in FIGS. 8 and 9 a front view and a right side view, respectively, of a decorative container 110 for receiving and storing a plumbing plunger in a generally upright position in accordance with the second preferred embodiment of the present invention. The container 110 is comprised of a base member 112 and a cover member 114. In the second preferred embodiment, both the base member 112 and the cover member 114 are molded of a plastic material which is preferably of a type well known to those of ordinary skill in the art. Preferably, both the base member 112 and the cover member 114 are made of the same plastic material. Preferably, the plastic is made of antibacterial material, which can be bacteriocidal and/or bacteriostatic. More preferably, the plastic is made from antimicrobial material. Most preferably, the plastic is made from antiseptic material.

Figure 10:
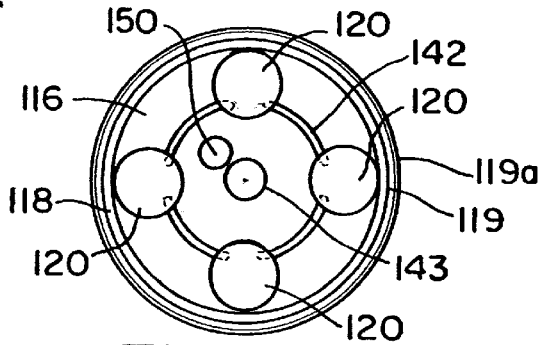
FIG. 10 is a bottom plan view of the container shown in FIG. 8.
Figure 11:
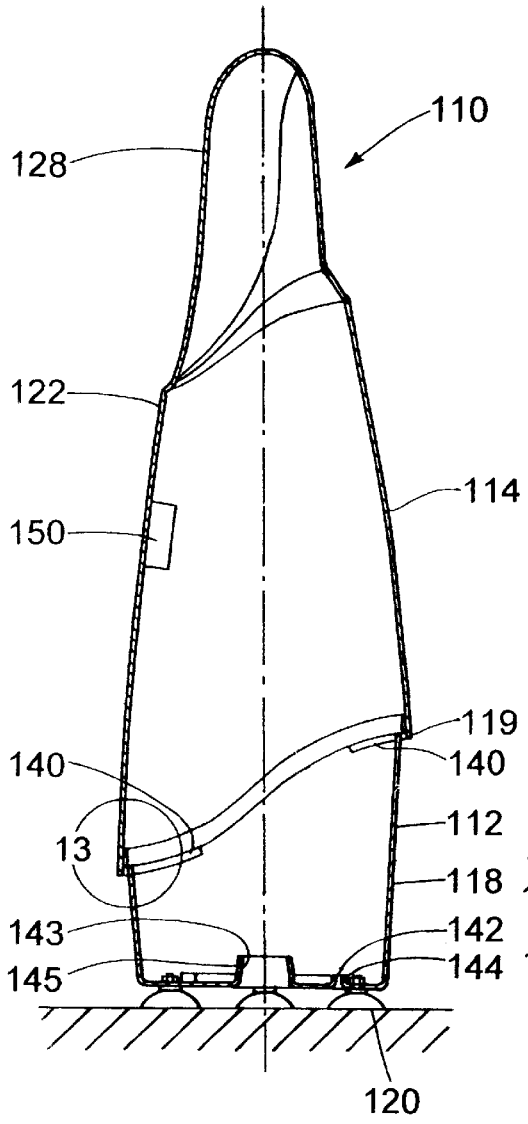
FIG. 11 is a cross-sectional view of the container shown in FIG. 8 taken along line 11–11 of FIG. 8.

Referring to FIGS. 8 and 10, the base member 112 is generally circular in plan view and is comprised of a generally flat bottom wall 116 and an adjoining, generally cylindrical sidewall 118. Although it is preferred that the base member 112 is circular in plan view, those skilled in the art will realize that other shapes, such as octagonal, can be used. As best shown in FIGS. 8, 9, and 11, the sidewall 118 extends generally upwardly from the upper side of the bottom wall 116 by a predetermined distance and extends around a perimeter of the bottom wall 116. In this manner, the base member 112 is generally bowl-like in configuration. As can be seen in FIGS. 9 and 11, the sidewall 118 need not extend the same height from the bottom wall 116 around the perimeter of the bottom wall 116. As shown in FIG. 13, a top portion of the sidewall 118 extends radially outwardly beyond the sidewall 118 to establish a generally continuous supporting lip 119 which extends around a perimeter of the sidewall 118 for purposes which will hereinafter become apparent. Preferably, the supporting lip 119 includes an overhang 119*a*, which extends downward from a free edge of the supporting lip 119 around a perimeter of the supporting lip 119, for reasons which will hereinafter become apparent. Preferably, an upper portion 118*a* of the sidewall 118 above the supporting lip 119 tapers inwardly. Also preferably, the base member 112 is sized so that it can conveniently receive and retain within the area defined by the sidewall 118 virtually any standard size plunger 130 (see FIG. 12) such that at least a substantial portion of the functioning portion 132 of the plunger 130 is contained within the sidewall 118, which serves as a retainer wall. In this manner, any excess liquid, solid or other material which may remain on the plunger 130 after use is captured and maintained within the base member 112 once the plunger 130 is installed therein, as shown in FIG. 12.

As best shown in FIG. 10, the underside of the bottom wall 116 of the base member 112 includes four spaced apart feet 120 extending from the base member 112. The feet 120 function to raise the base member 112 a predetermined distance above the surface of a floor "F" or other supporting surface. Preferably, the feet 120 are in the form of suction cups so that once the base member 112 is positioned on the floor F or other supporting surface, the feet 120 also function to secure or hold the base member 112 in place. Preferably, the suction cups are made of a rubber material and are positioned on the bottom wall 116 so that the intersections of centers of adjacent feet 120 generally form a quadrilateral. Although four (4) feet 120 are preferred, those skilled in the art will realize that more than four (4) or less than four (4) feet 120 can be used.

The cover member 114 is generally frusto-conically shaped and includes a sidewall 122 which tapers to a generally smoothly curved dome-shaped upper portion 128. A lower end 126 of the cover member 114 is generally circular in cross section and is sized to have an inside dimension which is slightly greater than the outside dimension of the upper portion 118*a* of the sidewall 118 of the base member 112 above the supporting lip 119. Preferably, the sidewall 122 of the cover member 114 tapers inwardly generally from the lower end 126 toward the upper portion 128 in substantially the same manner and extent as the inward taper of the upper portion 118*a* of the sidewall 118 of the base member 112 above the supporting lip 119 so that when the cover member 114 is installed on the base member 112 as shown in FIGS. 9, 12, and 13, the upper portion 118*a* of the sidewall 118 of the base member 112 above the supporting lip 119 is surrounded by and engages the corresponding lower end 126 of the sidewall 122 of the cover member 114 with a snug overlapping fit. As best shown in FIGS. 11 and 13, the lower end 126 of the cover member 114 engages and is releasably positioned on the supporting lip 119 of the sidewall 118, and extends slightly beyond the sidewall 118 as hereinbefore described.

Figure 12:
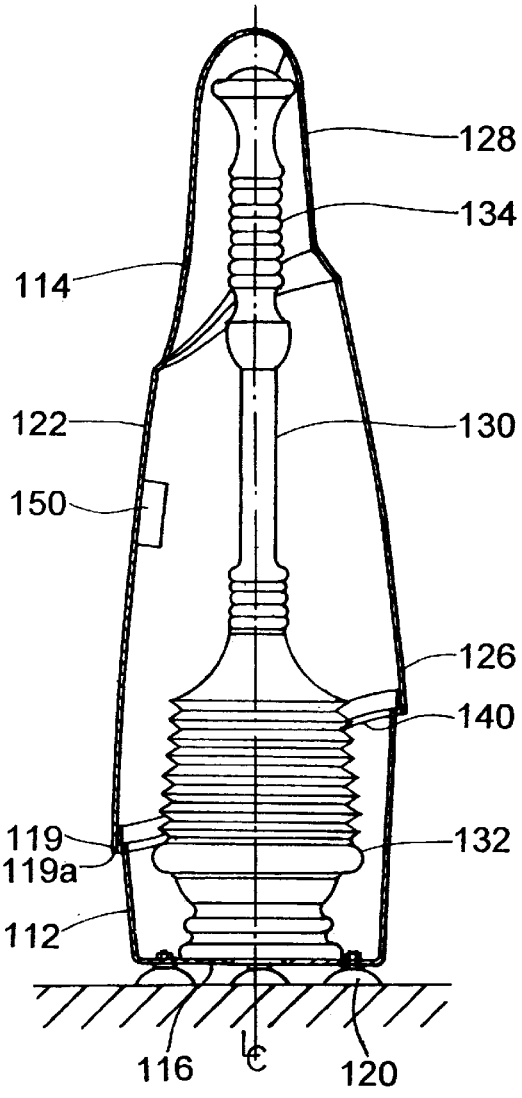
FIG. 12 is a cross-sectional view of the container shown in FIG. 8 taken along line 11–11 of FIG. 8 and showing a plunger stored within the container.
Figure 13:
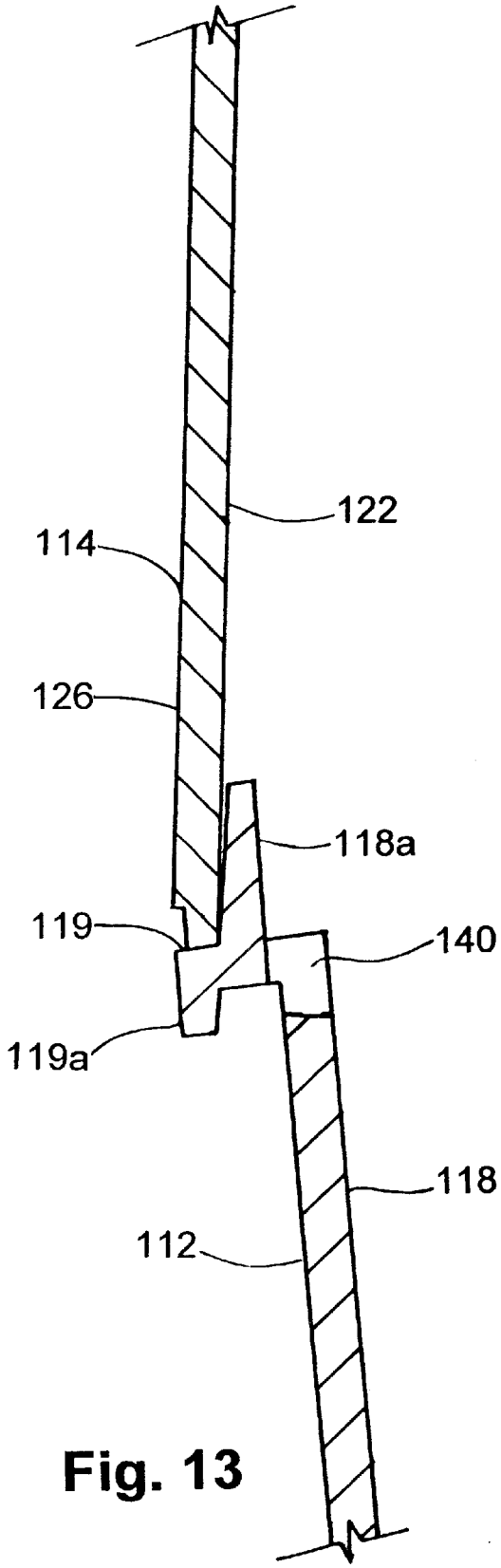
FIG. 13 is a greatly enlarged fragmentary view of the supporting lip and ventilation slot shown of the container shown in FIG. 11.

Preferably, the length or height of the container 110 is at least slightly greater than the overall length of a standard plumbing plunger 130, as shown in FIG. 12, and more preferably is at least slightly greater than the overall length of the longest standard plumbing plunger. Preferably, the diameter of the bottom wall 116 is at least slightly greater than the diameter of a functioning portion 132 of the standard plumbing plunger 130 and more preferably is at least slightly greater than the diameter of the largest functioning diameter of the largest standard plumbing plunger. Preferably, the taper of the sidewall 122 of the cover member 114 is such that the interior dimension proximate the upper portion 128 of the cover member 114 is large enough to receive the distal end of the handle 134 of any standard plumbing plunger 130 when held in an upright position as shown in FIG. 12.

As best shown in FIG. 11, a plurality of elongated openings or slots 140 extend through part of the sidewall 118 of the base member 114. Preferably, the slots 140 are proximate to the supporting lip 119 such that the overhang 119*a* of the supporting lip 119 extends over the slots 140 in a manner to at least partially conceal the slots 140 from being externally viewed, and yet allow air to pass through the slots 140 to and from the interior of the container 110. Preferably, each slot 140 is diametrically opposed from a corresponding slot 140 to provide cross-ventilation to the interior of the container 110 to facilitate the removal of odor, to permit the escape of any moisture held within the base member 112, and to otherwise maintain a plumbing plunger 130 contained within the container 110 in a serviceable condition. Although, in the preferred embodiment, two (2) slots 140 are shown, those skilled in the art will realize that more than two (2) slots 140 can be used.

As shown in FIGS. 10 and 11, the bottom wall 116 of the base member 112 has a plurality of holes arc-shaped 142 and a generally centrally disposed circular hole 143 extending therethrough. The arc-shaped holes surround the circular hole 143. Ends of the arc-shaped holes 142 are shown in phantom. The perimeter 144, 145 of each of the arc-shaped holes 142 and the circular hole 143, respectively, is at least slightly raised above the level of the bottom wall 116. The raised perimeter 144, 145 of each hole 142, 143, respectively, prevents any water which drains from the functioning portion 132 of the plunger 130 from draining out of the hole 142, 143 and onto the floor F. The holes 142, 143 are in fluid communication with an internal cavity of the functioning portion 132 of the plunger 130 to facilitate the evaporation of water trapped between the functioning portion 132 of the plunger 130 and the bottom wall 116, assisting the removal of odor from the container 110.

Preferably, at least one deodorizer 150 can be affixed to the container 110 to reduce and/or eliminate any odors which may emanate from the container 110 and/or the plunger 130. The deodorizer 150 can be affixed to the exterior of the container 110 as shown in FIGS. 8–10, and/or the deodorizer 150 can be affixed to the interior of the container 110 as shown in FIGS. 11–12. Preferably, the deodorizer 150 can be removed/replaced after it ceases to deodorize. The deodorizer 150 can be directly affixed to the container 110 with double-sided tape or other adhesive known to those skilled in the art. Alternatively, the deodorizer 150 can be removably inserted into a holder (not shown) which is permanently affixed to the container 110.

Although the container 110 as disclosed above is preferred, those skilled in the art will realize that a much simpler container, comprising just the base 112, the cover 114 and a plurality of feet 120 are sufficient as long as the base includes at least one hole 142 or 143, as well as the respective raised perimeter 144 or 145, for ventilation and drainage purposes.

In using the container 110, the base member 112 is preferably placed at a desired location on the floor F or other supporting surface for storing the plumbing plunger 130. The base member 112 is then pushed downwardly toward the floor F or other supporting surface so that the suction cup feet 120 are actuated to engage and hold the base member 112 at the desired position on the floor F or other supporting surface. It may be desirable to place a small amount of water on the undersurface of each of the suction cup feet 120 to improve gripping force between the feet 120 and the floor F or other supporting surface. A plumbing plunger 130 may then be placed on the base member 112 in the area inside the sidewall 118 in an upright position with the handle 134 of the plumbing plunger 130 extending upwardly as shown in FIG. 12. As previously noted, any liquid or solid materials left on the functioning portion 132 of the plumbing plunger 130 are captured and retained within the base member 112. In this manner, the floor F or other supporting surface is kept clean and sanitary.

Once the plumbing plunger 130 is installed within the base member 112 in an upright position as shown in FIG. 12, the cover member 114 is installed over the base member 112 as shown in FIGS. 8, 9, and 11. Since the interior dimension of the container 110 is at least slightly greater than the dimensions of the plumbing plunger 130, the installation of the cover member 114 does not effect the upright position of the plumbing plunger 130. The lower end 126 of the cover member 114 engages and is supported by the supporting lip 119. As previously noted, the lower end 126 of the sidewall 122 of the cover member 114 tightly engages the corresponding upper portion 118*a* of the sidewall 118 of the base member 112 with a snug fit to thereby effectively secure the cover member 114 to the base member 112. In this manner, it is difficult for small children or pets to remove the cover member 114 from the base member 112 and thereby obtain access to the plumbing plunger 130. Alternatively, the cover member 114 can engage the base member 112 with a snap-fit, a threaded fit, or other types of fits known to those skilled in the art. As previously stated, the slots 140 extending through the cover member 114 on the sidewall 118 provide cross ventilation to facilitate the removal of any moisture, odors or the like from the interior of the container 110 while the plumbing plunger 130 is being stored. Additionally, the holes 142, 143 in the base facilitate the evaporation of any moisture, odors and the like from the interior of the functioning portion 132 of the plunger 130.

When it becomes necessary to use the plumbing plunger 130, the cover member 114 is removed by pulling the cover member 114 straight upwardly. Because of the suction cupfeet 126, the base member 112 remains secured to the floor F or other supporting surface. By pulling the cover member 114 straight upwardly with respect to the base member 112, the plumbing plunger 130 remains in its upright position and is exposed and ready for use. The plumbing plunger 130 may then be removed from the base member 112 for use in breaking up a clog or the like. Thereafter, the plumbing plunger 130 may be returned to the base member 112 and the cover member 114 may be reinstalled on the base member 112 as described above.

From the foregoing description of a preferred embodiment, it can be seen that the present invention comprises a container for storing plumbing plungers. The container is adapted for receiving virtually any size plumbing plunger and for maintaining the plumbing plunger stored therein in a clean, safe, upright condition. It will be appreciated by those skilled in the art that changes could be made to the embodiments described above without departing from the broad inventive concept thereof It is understood, therefore, that this invention is not limited to the particular embodiment disclosed, but it is intended to cover modifications within the spirit and scope of the present invention as defined by the appended claims.

What is claimed:

1. A decorative container for receiving and storing a plumbing plunger in a generally upright position comprising:

a base having a bottom wall and a sidewall extending upwardly from the bottom wall by a predetermined distance and extending around a perimeter of the bottom wall, the sidewall having a supporting lip extending around a perimeter of the sidewall, a first part of the sidewall of the base proximate to the supporting lip has a first ventilation opening extending therethrough, the first ventilation opening being at least substantially unobstructed such that air can pass therethrough between an interior and exterior of the container, the supporting lip extends over the first ventilation opening, the supporting lip at least partially concealing the first ventilation opening from being externally viewed; and a cover being releasably positioned on the supporting lip and having a lower end and a sidewall, the lower end of the cover surrounding the sidewall of the base.

2. The decorative container as recited in claim 1 wherein the base includes a plurality of spaced apart supporting feet extending therefrom.

3. The decorative container as recited in claim 2 wherein the feet comprise suction cups.

4. The decorative container as recited in claim 1 wherein the base further includes a plurality of slots extending therethrough.

5. The decorative container as recited in claim 4 wherein an opposing second part of the sidewall of the base proximate to the supporting lip has a second ventilation opening extending therethrough, the second ventilation opening being at least substantially unobstructed such that air can pass therethrough between the interior and exterior of the container, the supporting lip extending over the second ventilation opening, the supporting lip at least partially concealing the second ventilation opening, from being externally viewed.

6. The decorative container as recited in claim 5, wherein the bottom wall of the base has a plurality of holes extending therethrough.

7. The decorative container as recited in claim 6, wherein the bottom wall of the base further comprises a raised perimeter extending upwardly from the bottom wall surrounding each of the plurality of holes.

8. The decorative container as recited in claim 6, wherein at least one of the plurality of holes is in fluid communication with an internal cavity of a functioning portion of a plumbing plunger.

9. The decorative container as recited in claim 1 wherein the cover is sized and shaped to receive a handle of a plumbing plunger.

10. The decorative container as recited in claim 1 wherein the base is generally circular and the sidewall of the base is generally cylindrical.

11. The decorative container as recited in claim 1 wherein the base and the cover are made of generally antiseptic material.

12. The decorative container as recited in claim 1 further comprising a deodorizer connected to the decorative container.

13. A combination plumbing plunger and decorative container for receiving and storing the plumbing plunger in a generally upright position comprising:

a decorative container including:

a base having a bottom wall and a sidewall extending upwardly from the bottom wall by a predetermined distance and extending around a perimeter of the bottom wall, the sidewall having a supporting lip extending around a perimeter of the sidewall, the sidewall tapering inwardly above the supporting lip;

a cover being releasably positioned on the supporting lip and having a lower end and a sidewall, the lower end of the cover member surrounding and snugly engaging the sidewall of the base above the supporting lip, the sidewall of the cover tapering generally inwardly from the lower end to an upper portion; and a plumbing plunger being removably stored within the decorative container.

14. The combination plumbing plunger and decorative container as recited in claim 13 wherein the base includes a plurality of spaced apart supporting feet extending therefrom.

15. The combination plumbing plunger and decorative container as recited in claim 14 wherein the feet comprise suction cups.

16. The combination plumbing plunger and decorative container as recited in claim 13 wherein the base further includes a plurality of slots extending therethrough.

17. The combination plumbing plunger and decorative container as recited in claim 16 wherein a first part of the sidewall of the base proximate to the supporting lip has a first ventilation opening extending therethrough, and an opposing second part of the sidewall of the base proximate to the supporting lip has a second ventilation opening extending therethrough, the supporting lip extending over the first and second ventilation openings, the supporting lip at least partially concealing the first and second ventilation openings.

18. The combination plumbing plunger and decorative container as recited in claim 17, wherein the bottom wall of the base has a plurality of holes extending therethrough.

19. The combination plumbing plunger and decorative container as recited in claim 18, wherein the bottom wall of the base further comprises a raised perimeter extending upwardly from the bottom wall surrounding each of the plurality of holes.

20. The combination plumbing plunger and decorative container as recited in claim 18, wherein at least one of the plurality of holes is in fluid communication with an internal cavity of a functioning portion of the plumbing plunger.

21. The combination plumbing plunger and decorative container as recited in claim 13 wherein the cover is sized and shaped to receive a handle of the plumbing plunger.

22. The combination plumbing plunger and decorative container as recited in claim 13 wherein the base is generally circular and the sidewall of the base is generally cylindrical.

23. The combination plumbing plunger and decorative container as recited in claim 13 wherein the base and cover are made of generally antiseptic material.

24. The combination plumbing plunger and decorative container as recited in claim 13 further comprising a deodorizer connected to the decorative container.

25. A decorative container for receiving and storing a plumbing plunger in a generally upright position comprising:

a base having a bottom wall, the bottom wall having a plurality of holes extending therethrough and a sidewall extending upwardly from the bottom wall by a predetermined distance and extending around a perimeter of the bottom wall, the sidewall having a supporting lip extending around a perimeter of the sidewall, a first part of the sidewall of the base proximate to the supporting lip has a first slot extending therethrough, the supporting lip extends over the first slot, the supporting lip at least partially concealing the first slot from being externally viewed; and a cover being releasably positioned on the supporting lip and having a lower end and a sidewall, the lower end of the cover member surrounding the sidewall of the base.

26. The decorative container as recited in claim 25 wherein one of the plurality of holes is generally centrally disposed in the base.

27. The decorative container as recited in claim 25 further comprising a deodorizer.

28. A combination plumbing plunger and decorative container therefor, the combination comprising:

a decorative container including:

a base having a bottom wall and a sidewall extending upwardly from the bottom wall by a predetermined distance and extending around a perimeter of the bottom wall, the sidewall having a supporting lip extending around a perimeter of the sidewall, a first part of the sidewall of the base proximate to the supporting lip has a first slot extending therethrough, the supporting lip extends over the first slot, the supporting lip at least partially concealing the first slot from being externally viewed; and a cover being releasably positioned on the supporting lip and having a lower end and a sidewall, the lower end of the cover member surrounding the sidewall of the base; and a plumbing plunger being removably stored within the decorative container.

29. The combination plumbing plunger and decorative container as recited in claim 28, wherein the bottom wall of the base has a plurality of holes extending therethrough.

30. The combination plumbing plunger and decorative container as recited in claim 29, wherein the bottom wall of the base further comprises a raised perimeter extending upwardly from the bottom wall surrounding each of the plurality of holes.

31. The combination plumbing plunger and decorative container as recited in claim 29, wherein at least one of the plurality of holes is in fluid communication with an internal cavity of a functioning portion of the plumbing plunger.

32. The combination plumbing plunger and decorative container as recited in claim 29, wherein the base and the cover are made of generally antiseptic material.

33. The decorative container as recited in claim 28 and further comprising a deodorizer connected to the container.

34. A combination plumbing plunger and decorative container therefor, the combination comprising:

a decorative container including:

a base having a bottom wall, the bottom wall having a plurality of holes extending therethrough and a sidewall extending upwardly from the bottom wall by a predetermined distance and extending around a perimeter of the bottom wall, the sidewall having a supporting lip extending around a perimeter of the sidewall, a first part of the sidewall of the base proximate to the supporting lip has a first slot extending therethrough, the supporting lip extends over the first slot, the supporting lip at least partially concealing the first slot from being externally viewed; and a cover being releasably positioned on the supporting lip and having a lower end and a sidewall, the lower end of the cover member surrounding the sidewall of the base; and a plumbing plunger being removably stored within the decorative container.

35. The decorative container as recited in claim 34 and further comprising a deodorizer connected to the container.

36. A combination plumbing plunger and decorative container therefor, the combination comprising:

a decorative container including:

a base having a bottom wall, the bottom wall having a plurality of holes extending therethrough and a raised perimeter extending upwardly therefrom surrounding each of the holes;

a cover being releasably positioned on the base; and a plumbing plunger being removably stored within the decorative container.

37. The combination as recited in claim 36 wherein one of the plurality of holes is generally centrally disposed in the base and is in fluid communication with an interior cavity of a functioning portion of the plumbing plunger.

38. The decorative container as recited in claim 36 and further comprising a deodorizer connected to the container.

* * * * *